US006267711B1

(12) United States Patent
Hinds

(10) Patent No.: US 6,267,711 B1
(45) Date of Patent: Jul. 31, 2001

(54) ELASTIC CORD EXERCISE ASSEMBLY

(76) Inventor: Robert Sylvester Hinds, 1803 Regent St., Madison, WI (US) 53705

( * ) Notice: Subject to any disclaimer, the term of this patent is extended or adjusted under 35 U.S.C. 154(b) by 0 days.

(21) Appl. No.: 09/112,091

(22) Filed: Jul. 9, 1998

(51) Int. Cl.[7] ..... H03B 21/02
(52) U.S. Cl. ..... 482/121; 482/904; 482/129
(58) Field of Search ..... 482/121, 122, 482/129, 904, 908, 148, 123, 114–120, 686, 694

(56) References Cited

U.S. PATENT DOCUMENTS

| | | | |
|---|---|---|---|
| 77,676 | 5/1868 | Swett . | |
| 232,579 | 9/1880 | Weeks . | |
| D. 277,218 | 1/1985 | Hinds | D21/191 |
| 1,112,114 | 9/1914 | Caines . | |
| 1,965,511 | 7/1934 | Preston . | |
| 3,430,953 | 3/1969 | Teetor | 272/62 |
| 3,584,821 | 6/1971 | Glebe | 248/156 |
| 3,847,422 | 11/1974 | Gulistan | 292/60 |
| 3,956,911 | 5/1976 | Carboud | 70/109 |
| 3,984,136 | 10/1976 | Bills | 292/182 |
| 4,018,437 | 4/1977 | LoPresti | 272/62 |
| 4,109,907 | 8/1978 | Zito | 272/117 |
| 4,113,221 | 9/1978 | Wehner | 406/248 |
| 4,182,510 | 1/1980 | Lundell | 272/93 |
| 4,185,816 | 1/1980 | Bernstein | 272/93 |
| 4,212,458 | 7/1980 | Bizilia | 272/93 |
| 4,412,677 | 11/1983 | Viramontes | 272/62 |
| 4,419,990 | 12/1983 | Forster | 128/75 |
| 4,481,964 | 11/1984 | Minneman | 135/66 |
| 4,662,629 | 5/1987 | Plovie | 272/62 |
| 4,676,021 | 6/1987 | Groba | 42/94 |
| 4,772,011 | 9/1988 | Guridi | 272/62 |
| 4,779,867 | 10/1988 | Hinds | 272/137 |
| 4,787,626 | 11/1988 | Gallagher | 272/93 |
| 4,809,971 | 3/1989 | Goldish | 272/93 |
| 4,848,741 | 7/1989 | Hermanson | 272/135 |
| 4,944,518 | 7/1990 | Flynn | 273/186 A |
| 5,135,445 | 8/1992 | Christensen et al. | 482/10 |
| 5,176,602 | 1/1993 | Roberts | 482/131 |
| 5,342,274 | 8/1994 | Hunker | 482/140 |
| 5,354,253 | 10/1994 | Awbrey et al. | 482/111 |
| 5,431,617 | 7/1995 | Rattray, Jr. | 482/129 |
| 5,505,677 | 4/1996 | Hinds | 482/10 |
| 5,514,059 | 5/1996 | Rumney | 482/124 |
| 5,540,643 | 7/1996 | Fontaine | 482/143 |
| 5,549,532 | 8/1996 | Kropp | 482/126 |
| 5,571,064 | 11/1996 | Holm | 482/129 |
| 5,626,546 | 5/1997 | Little | 482/129 |

FOREIGN PATENT DOCUMENTS

| | | |
|---|---|---|
| 27611 | 2/1899 | (GB) . |
| 116404 | 9/1900 | (GB) . |

*Primary Examiner*—Jerome Donnelly
(74) *Attorney, Agent, or Firm*—Loyd W. Bonneville

(57) ABSTRACT

An elastic cord exercising assembly optionally capable of mounting upon the face of a door without inflicting damage upon it and comprising guide rails and channels; pulley tethering crossbars for which height is adjustable by employment of spring loaded pin latches; and acentric pulley assemblies which facilitate reestablishing exercise tethering points by the operator, together with accessories including an operator stabilization bar.

18 Claims, 7 Drawing Sheets

ELASTIC CORD EXERCISE ASSEMBLY

BACKGROUND OF THE INVENTION

1. Field of the Invention

Gymnastic devices; adjustable utility frames; pulleys; hangers; spring loaded connectors 2. Description of the Prior Art Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term acentric pulley assembly (19) might be used in one instance but in another, if meaning is otherwise clear from context, expression might be shortened to pulley assembly (19 ) or merely assembly (19). Any of those forms is intended to convey the same meaning.

The term emplace or any of its forms when used in this application means the joining of two objects or parts so as to unite them in a reasonably easily removable way, such as the fitting of a length of elastic exercise cord (27) within a pulley wheel's circumferential groove (36) from which it (27) may be removed, discussed ante.

Where the term is employed, rigid emplacement connotes the meaning that the object is removable but only with some degree of difficulty, such as might be encountered in separating two parts—for example, an aperture engaging pin (15) from a guide rail latching aperture (3) in which it (15) is held in position by expansion of a spring (16). The word emplace is also consistent in meaning with the word "detachable" as occasionally used in connection parlance but not in this application, since it is derived from the root attach The term attach or fasten or any of their forms when so used means that the juncture is of a more or less permanent nature, such as might be accomplished by nails, screws, welds or adhesives. Employment of the words connect or join or any of their forms is intended to include the meaning of both in a more general way.

The word comprise may be construed in either of two ways herein. A generic term used to describe a given one of a number of specific elements is said to comprise it, thereby characterizing the specific element with equivalency in meaning for the generic term. Thus, an exercise tethering point (300) may be said to comprise a pulley wheel (35), meaning that in the particular case, the wheel (35) is the tethering point (300). However, the word comprise may also be used to describe a feature which is part of the structure or composition of a given element. Thus, a door connecting bracket tongue (56) may be said to comprise a machine threaded retracting bolt aperture (57), meaning that the structure of the tongue (56) is such as to have the retracting bolt aperture (57) as a feature of its structure. The meaning in the respective cases is clear from context, however. Accordingly, modifying words to clarify which of the two uses is the intended one seem unnecessary.

The word multiply or any of its derivatives is also employed in two different ways, either as a verb or an adjective. Thus, it is explained herein that the number of tethering point (300) arrangements is multiplied by reason of the number of axes of rotation a pulley assembly (19) comprises—the verb sense, in that the assembly's diversity permits an operator (200) to multiply the number of setups he or she elects to exercise from. Used as an adjective, however, it is said herein that a multiply elbowed door connection bracket (52) comprises door edge wrapping configuration (54)—meaning merely that it (52) is shaped with a number of elbows exceeding that of an alternative embodiment.

The term identically oriented parallel means that two given objects are faced in the same direction in parallel disposition, such as a pair of rail frames (44), discussed ante, would be if mounted upon a wall (106) or door face (101). Where two such objects are situated so as to face one another, the terminology facially opposing is used, such as when a pair of rail frames (44), ante, is installed within a door jamb (104), thus distinguishing such disposition from that of identical orientation.

As employed herein, the word encircle or circumscribe or any of their variant root forms describes a path about the perimeter of an object, but when used in conjunction with appropriate modifiers, such as to a predetermined degree or the like, means that the path may not necessarily be a complete one. For example, when it is said that a crossbar tethering leg ring (22) encircles a crossbar (5) to a predetermined degree and the degree thereof is unexpressed, the line of circumscription may be either partial or complete. When the degree is expressed—such as with the adverb partially, the progression of the line around the object is, by definition herein, less than complete. For the sake of specificity herein, terminology indicating that encirclement is partial, is defined herein to mean that the line progression comprises a range up to and including 300 degrees—that is, 60 degrees short of complete encirclement. Terminology indicating that encirclement is substantial, is defined to mean that the line progression comprises a range between 301 degrees and complete encirclement.

The terminology axial or any of its variant forms when applied to the concept of rotation is intended to designate rotation upon a longitudinal axis. This would be demonstrated if an elongated object such as a pulley axle (33) were observed to spin, in which case rotation would be indicated herein to be axial. The same would be true of a pulley wheel (35) upon that axle (33). When for an elongated object such as that referred to supra, rotation is at right angles or transverse to the longitudinal axis, the rotation would be characterized herein to be in axial transversion. Such would be the rotation of a swivel (24) upon an axle impaling one of its (24) ends.

There is a distinct difference between exercising assemblies which employ weights attached to inelastic cords strung through a pulley and those which employ a length of elastic cord tethered from a given point. As an operator (200) pulls upon an inelastic cord to which a weight is attached, sufficient initial effort must be expended to overcome the weight's resting inertia. As the effort continues and the weight gathers momentum, less effort is required. Even after the effort is terminated, the weight continues for a short distance in its path, reaches maximum height and then begins to fall, pulling the cord with it, in response to gravity. It is sometimes said to have "gone ballistic".

The tension exerted upon an elastic cord as it is stretched, increases beginning from its initial state of rest completely up to the point of maximum effort. The cord immediately begins retracting upon reversing the effort. Many consider the acceleration gradient imposed by an elastic cord to be highly beneficial.

Weights also have other disadvantages such as the necessity to store them to avoid clutter and the inconvenience of having to change them for one's different exercises or accommodate an additional exercising operator. Employing proper equipment, elastic cords of lesser or greater resistance and strung upon a pulley assembly may be easily changed, or alternatively, left in place by a first operator (200) without interfering with the efforts of a second one (200) who uses an independently pulleyed cord of different resistance.

Elastic cord assemblies have traditionally been attached to a wall (106) to provide what are referred to herein as exercise tethering points(300). However, many people have limited wall (106) space available for such installation. The bulky character of the traditional exercise assemblies and the want of sufficient installation space for them have led to portable models which provide for various isometric or isotonic exercises. While portability avoids installation problems and enables use away from home, many feel there is no real substitute for an anchoring vertical surface mounted construction.

There has been a growing interest in tethering exercise equipment to a less obtrusive locale such as upon a household door (100) or within the doorway (103) itself during a time it is not otherwise required for ingress and egress.

Assemblies intended for doorway (103) use have taken a variety of forms. While some have been anchored upon the encircling woodwork, attachment is more frequently made upon the jamb (104) within the doorway's (103) interior. That portion of an assembly which might otherwise interfere with those passing through it should be easily removable after exercise.

Some of the portable models, supra, have been configured with door (100) blockers or similar obstructions usually taking the form of thickened straps which are fitted through the margin or crack around the door's (100) perimeter such that they don't pull through when exercise tension is operably applied. Those models are referred to herein as comprising door stop or door impinging features, ante. As useful as those assemblies are, their tethering source is necessarily limited to the doorway's (103) perimeter. Efforts to provide for more centralized exercise tethering have contributed to development of door face (101) installation assemblies.

An assembly mounted upon the face (101) of a door (100) should be constructed so as not to damage it (100). Bolts driven into or through the door (100) leave unsightly holes when the assembly is removed. Some of the portable exercisers, supra, provide secure tethering with devices shaped to fit around the edge (102) of a closed door (100) at the top or bottom thereof (700). Those models are referred to herein as comprising door edge wrapping configurations. Some of the devices comprise a nonpenetrating bolt and plate to enhance security. Others are constructed for such purpose in a manner to insure that the fit is snug.

Once a framework has been erected, pulley assemblies may be emplaced upon them. While the pulleys are often connected from a hook or ring at a fixed site on a traditional assembly, emplacement upon horizontal crossbars spanning the assembly offers variation in tethering point (300) selection. Pulley assemblies should be configured to permit positioning them before exercise is undertaken so as to quickly and easily provide selected tethering points (300) at which they remain fixed in place when subjected to exercise tensions. They should also be configured to provide a sufficient number of pivot sites to allow rapid variations in tension and orientation without impeding their operation. Thus, a pulley emplacement or tethering ring should be configured so that it can be emplaced upon a crossbar rather than merely connected to a ring or hook. The tethering ring should comprise shape which permits it to be slid horizontally along the bar and pivot vertically upon its connection point when subjected to various exercise tensions but yet remain horizontally in place until it is repositioned. It should comprise capability to allow the pulley wheel to spin in response to forces imposed upon it by the elastic cord without allowing the cord itself to become twisted and should, therefore, comprise numerous axes of rotation.

Particular means would be required to confer upon a pulley assembly the characteristic of remaining in place following lateral adjustment without adding specific connecting parts to it. Means known in prior art, designated herein as acceleration varied virtual diameter (AVVD), which is related in concept to gravity varied virtual diameter (GVVD), further discussed ante, would be suitable for that purpose.

A pulley assembly should also be configured to permit quick and easy emplacement of the elastic cord upon a pulley wheel without risk of the cord's dislodgement from the assembly.

An exercise assembly should also permit quick and easy adjustments in height and should, therefore, comprise crossbar latching mechanisms operable with minimum effort. Certain features of pin and aperture connectors along a vertical guide rail occasionally employed in the past might still be useful if additionally provided with quick release features combined with firm rail locking capability to prevent accidental dislodgement. In that connection, spring loaded latch assemblies including those which are operably retractable are known in prior art, having been observed in applications including security locks for certain residential windows and in height adjusting mechanisms for some track hurdles.

An assembly should also comprise sufficient versatility by reason of interchangeability of its parts to permit mounting at any of the locales mentioned supra—that is, upon the wall (106), upon a door jamb (104) or upon a door's face (101)—and yet allow for exercise away from home with those parts thereof which lend themselves to portability, such as the elastic cords (27), operator tension manipulators (28) of one type or another and any door impinging devices available as accessories.

U.S. Pat. No. 232,579 issued to Weeks is a highly significant historical patent featuring an early wall (106) tethered exercise assembly, comprising handgrips as operator tension manipulators, pulleys and lengths of both elastic and inelastic cords. U.S. Pat. No. 1,112,114 issued to Caines also comprises a relatively early wall anchored elastic cord system. A subsequent such assembly is featured in U.S. Pat. No. 1,965,511 issued to Preston. U.S. Pat. No. 5,431,617 issued to Rattray, Jr. represents a more recent wall (106) tethered exercise assembly wherein several elastic cords are simultaneously employed. The assembly in U.S. Pat. No. 5,626,546 issued to Little invokes a wall (106) mounted guide rail framework comprising aperture engaging pins and spaced apertures along the sides for tethering height adjustment, simple channel engagement pins secured by cotter pins, as well as handgrips, pulleys and elastic cords.

U.S. Pat. No. 5,176,602 issued to Roberts also employs handgrips, pulleys and elastic cord as do the foregoing. While the patent focuses upon door (100) stop or door (100) impingement tethering, instructions are included therein to mount a rigid framework comprising spaced apertures upon the walls (106) in the corner of a room, the apertures providing tethering points (300) for apparatus connecting links. U.S. Pat. No. 4,848,741 issued to Hermanson illustrates a special framework upon which several pulley wheels are mounted in a selected pattern which permits lengthening or shortening the elastic cord to vary the tethering tension. U.S. Pat. No. 5,354,253 issued to Awbrey features an adjustable framework for underwater exercise also comprising spaced apertures, position adjusting brackets and simple pins secured either by cotter pins or nuts, although there is no specific reference to use of elastic cord.

Patents featuring elastic cord assemblies but employing door (100) stop or door (100) impingement tethering include U.S. Pat. Nos. 4,779,867 and 5,505,677 both issued to Hinds, U.S. Pat. No. 5,514,059 issued to Rumney, U.S. Pat. No. 5,549,532 issued to Kropp and U.S. Pat. No. 5,571,064 issued to Holm. The Hinds U.S. Pat. No. 5,505,677 supra, provides for enhanced tethering security by looping the anchoring strap around the doorknob. A very early door impinging variation is illustrated by one of the embodiments of Bussey, discussed ante.

Patents employing door edge (102) enwrapment tethering n include Great Britain (G.B.) Patent No. 27,611 issued to Bussey, G.B. Patent No. 16,404 issued to Wieland, U.S. Pat. No. 3,430,953 issued to Teetor, U.S. Pat. No. 4,018,437 issued to LoPresti, U.S. Pat. No. 4,109,907 issued to Zito, U.S. Pat. No. 4,182,510 issued to Lundell, U.S. Pat. No. 4,185,816 issued to Bernstein, U.S. Pat. No. 4,212,458 issued to Bizilia, U.S. Pat. No. 4,419,990 issued to Forster, U.S. Pat. No. 4,662,629 issued to Plovie, U.S. Pat. No. 4,787,626 issued to Gallagher, U.S. Pat. No. 4,809,971 issued to Goldish, U.S. Pat. No. 4,944,518 issued to Flynn, U.S. Pat. No. 5,135,445 issued to Christensen, U.S. Pat. No. 5,342,274 issued to Hunker, U.S. Pat. No. 5,540,643 issued to Fontaine and U.S. Pat. No. Des. 277,218 issued to Hinds. Almost all of these constructions include no exercise cord and are suitable only for situps and other exercises of an isotonic character enhanced by bracing a part of the body. Of this door edge enwrapment category, only the Bussey, Wieland and Hunker patents include a length of elastic cord.

The LoPresti patent represents one in which opposing elbowed bracing pins comprise an enwrapping structure from which an exercise frame is projected. The Zito patent comprises inelastic cord and weights. U.S. Pat. No. 4,412,677 issued to Viramontes is a chinning bar similar to the foregoing but provides for enwrapment over a garage door or an exposed joist, if available.

Caines and Preston, supra, are worthy of note among the early U.S. forerunners in this sector of interest. The same is true of the British works of Busseyand Wieland While all employ n elasticity as the exercise medium, none comprises a one-piece elastic free running cord such as would be integrated into a wheel and pulley system. While the Bussey device appears at first glance to incorporate a single cord which might be capable of sliding and stretching freely throughout its length, it in fact comprises "cords" "attached" at their "fast" ends. Even the single cord of Caines is secured at what might otherwise be interpreted as a free-sliding segment thereof. While the notion that elasticity could be successfully incorporated in conjunction with one or more wheels or similar pulley devices had long before been demonstrated by Weeks, more extensive development along those lines remained for others including Roberts and Hermanson, supra.

Employing a single running cord provides greater length through which its stretching occurs and, therefore, requires less exercise space within a given room for the same amount of cord stretch. Aside from valuable space conservation, this feature facilitates exercise of an aerobic-like character, since greater movement results from a given length of cord stretch than is the case with shorter cords. Those who train seriously understand well the benefits of left and right body-sided reciprocation in which the torso is urged to twist in response to a system's free-running elastic restraints. Attachment of shorter elastic cords, of course, also introduces an incidental safety concern in that they could become dislodged from their fastening sites.

Beyond the early beginnings exhibited by Weeks, Caines, Preston, Busseyand Wieland, the task remained of constructing a sophisticated system wherein the midportion of a single cord is quickly strung upon pulley wheels emplaced upon an easily adjusted framework optionally mounted upon a household door.

Even today, the foregoing efforts both here and abroad have been little improved upon. The elastic cords employed in the more recent patent of Little, for example, engage a vertical framework by means of solid attachment just as those of his forerunners did.

U.S. Pat. No. 4,772,011 issued to Guridi provides a doorway (103) assembly in which a tethering crossbar is emplaced in opposing spaced apertures in frames attached to the jamb (104). Special length contraction and extension features in the crossbar permit adjustments in height to be made.

Patents featuring spring loaded pin latch assemblies include U.S. Pat. No. 3,847,422 issued to Gulistan, U.S. Pat. No. 3,956,911 issued to Carboud, U.S. Pat. No. 3,984,136 issued to Bills and U.S. Pat. No. 4,113,221 issued to Wehner. While the spring of the Gulistan assembly is biased outwards, it perates upon the same principal as the inwardly biased ones. Biasing orientation is controlled by the location of the shoulder against which the spring is retracted and the shoulder in this device is merely reversed from that of an inwardly biased spring. The Gulistan pin is retained in nonretracted disposition by interthreading of parts.

The following patents utilize the principle of gravity varied virtual diameter (GVVD), intrinsically related in concept to acceleration varied virtual diameter (AWD), for emplacement of a cantilevered object and adjustment in height along a vertical standard: U.S. Pat. No. 4,676,021 issued to Groba; U.S. Pat. No. 4,481,964 issued to Minneman, wherein a post along which the cantilevered object is slid is comprised of scallops which also provide a partial stop to the adjusting ring; U.S. Pat. No. 3,584,821 issued to Gleeb, U.S. Pat. No. 1,666,293 issued to Lorton; U.S. Pat. No. 77,676 issued to Swett, in which the standard is also notched to improve reliability.

An exercise assembly should at least incorporate many of the best features of the cited constructions. As many as there are, however, none of them provide the totality of the modern athlete's requirements. An assembly should, therefore, comprise improved pulley systems and easily operable latching mechanisms. In summary, the needs or objectives pointed out supra thus far remain only partly addressed in the prior art and some have not been met at all.

SUMMARY OF THE INVENTION

The invention comprises an elastic cord exercising assembly capable of installation upon a wall (106), within a household doorway (103) and, of particular significance, upon the face (101) of a door (100) with components which do not scratch or otherwise damage the door's (100) surface. When installed upon a wall (106) or upon a door jamb (104), parallel guide rails (1) are attached to solid backing. Rail sliding receptors (7) emplaced upon the rails (1) and which carry crossbars (5) upon which pulley assemblies (19) are hung are expeditiously raised or lowered by manipulating the right and left retractable spring loaded pin latch assemblies (14) in quick succession. A pulley assembly (19) itself comprises acentric features facilitating lateral movement thereof (19) to an optimum position upon its crossbar (5) where it (19) becomes effectually locked in place by reason of the acentricity but from which it (19) is almost effortlessly displaced following exercise By reason of the combination of four axes of pulley assembly (19) rotation and the multitude of pin latching apertures (3) in the guide rails (1) which the receptor pin latch assemblies (14) can engage, a nearly infinite number of variations in assembly positioning are available.

For door jamb (104) assembly, the receptors (7) are specially configured to accommodate an across-the-doorway (103) spanning of the pulley assembly (19) and the seating of the ends (6) of the crossbars (5) into the opposing receptor faces (9). Special measures are entailed in doorway (103) installation including the cutting of the crossbars (5) to correctly fit the span as well as assuring that one or more receptor emplacement gaps (85) are disposed at the top or bottom of the jamb (104) for emplacement of the assembly in correct sequence.

For installation upon the face (101) of a door (100), the invention features a surface protecting door connecting assembly (50) wherein four brackets (52) seat across the edge (102) of the door (700) and engage the ends (42) of mounting channels (41) longitudinally attached to the guide rails (1) vertically disposed upon the door (100). The brackets (52) are configured with elbows to comprise retracting plate properties (59) wherein connecting tension is localized at points not in contact with the door's (100) surface. Two of them (52), however, are additionally elbowed both to clear doorway millwork and enhance connection security at the door's edge (102). The structure of the door surface protecting assembly (50) is such as to confer firm connecting strength upon the exercise assembly while avoiding any damage to the door (100).

Accessories include a cantilevered tethering projection (70) to provide an overhead tethering point (300) and a stabilizing bar (90) to provide the operator (200) a hand-held bracing fulcrum during exercise.

BRIEF DESCRIPTION OF THE DRAWINGS

Solid lines in the drawings represent the invention. Dashed lines represent prior art or otherwise noninventive material including that which is the subject of another patent application.

DESCRIPTION OF THE PREFERRED EMBODIMENT

Figure 1:
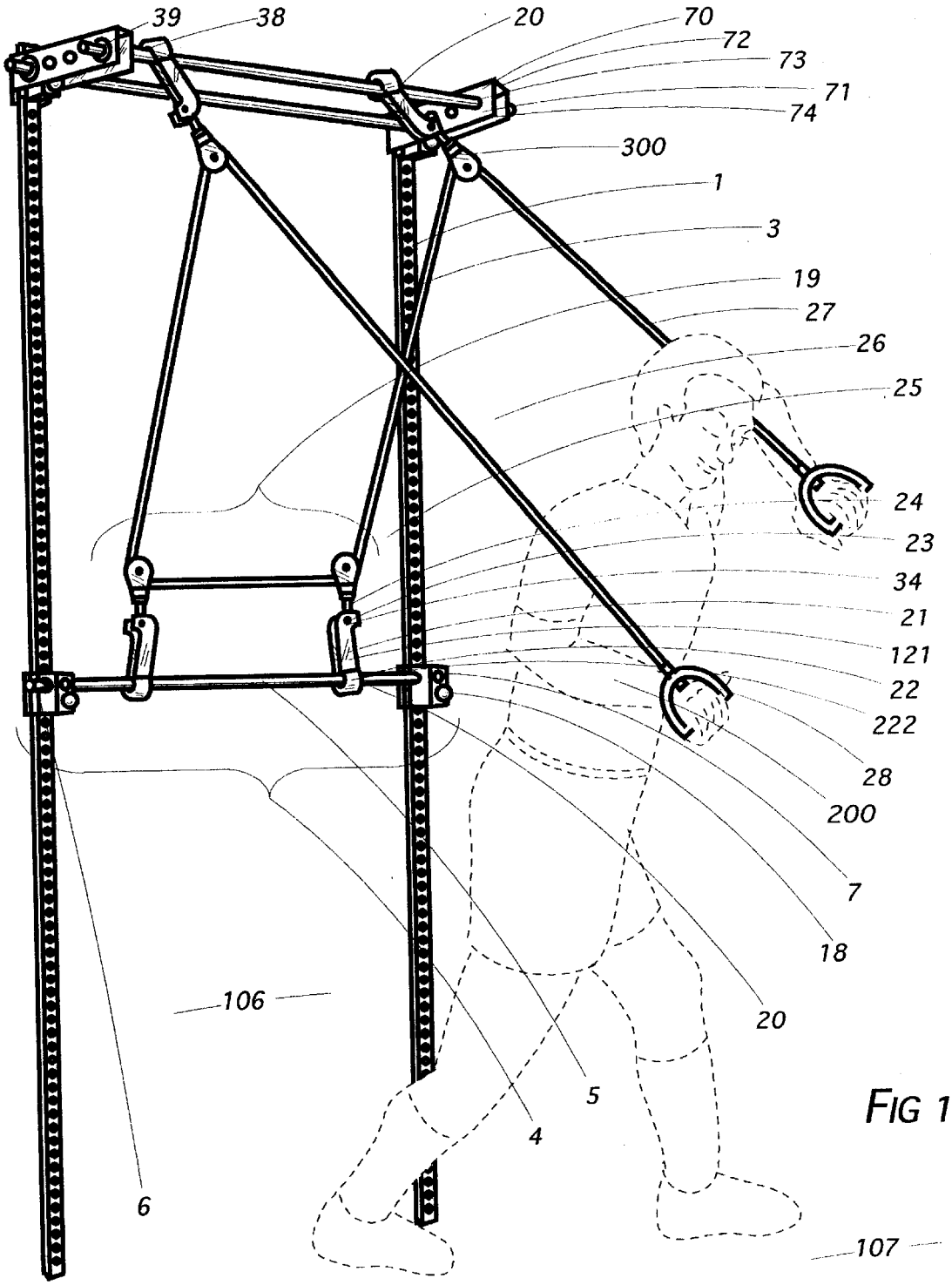
FIGS. 1–3 represent perspective views of the invention, comprising most of the features present when mounted upon a vertically supportive surface such as a wall (106) and illustrating optional arrangements thereof for various exercise postures.

The invention in general comprises an assembly of parts which enhance traditional exercise techniques. Some of the parts are already known to the prior art while others are new. The invention demonstrates novelty both in a combination of those parts as well as in certain of the individual parts themselves.

The subject of this application is an elastic cord exercising assembly comprising in part a pair of vertically disposed guide rails (1), a height adjusting pulley tethering assembly (4) and an operator tension manipulating assembly (26).

The guide rails themselves (1) may take any one of several forms but are already available commercially in very useful embodiments which are easily modified for a manufacturer's particular use. For the sake of interchangeability, economy of manufacture and aesthetics, each rail (1) should be equal in length with respect to the other (1).

Many exercise assemblies comprise what is referred to herein as a tethering point (300)—or, the point on the assembly from which the operator (200) directionally draws tension during exercise. The stationary part of the assembly is generally constructed upon a vertical surface such as a wall (106) or the face of a door (101). However, as suggested supra, it may be On mounted within a door jamb (102), in which case the operator (200) has the additional space within the doorway (103) to maneuver in. In either case, the connection is generally made by attachment, preferably by means of screws or bolts, into solidly backed supporting stud type building material. Attachment may also be made into masonry. This application specifically addresses the inherent problem of avoiding damage to a door's face (101) where such is the fixed site for the assembly.

While the guide rails (1) may take any one of several forms, well known "I" beam configuration—that is, a guide rail cross section (2) shaped like the letter "I"— is preferred both for reasons of integral strength and to accommodate a sliding structure mated to the rail's (1) shape, an aspect of the invention further discussed ante. The rails (1) also comprise spaced latching apertures (3) along their (1) entire length. Where the supporting surface is a wall (106) or door jamb (104), the guide rails themselves (1) are most often attached directly to it (106, 104, respectively) in vertically parallel fashion. Installation means are further discussed ante.

The terminology spaced latching apertures (3) merely means that any given aperture (3) is distinctly situated a short distance from another one (3). In manufacture, each member of the rail (1) pair should be made to comprise the same number of apertures and there should be the same spacing between them in one rail (1) as there is in the other (1). While the apertures (3) may be formed along any accessible longitudinal surface of the rail (1), the embodiment featured herein disposes them (3) therein (1) along the face—that is, the surface thereof (1) directed outward toward the operator (200). On any given rail, the apertures (3) must be situated in a straight longitudinal line from one end of the rail (1) to the other. For reasons related to aesthetics and economy of manufacture, it is preferable, though not essential, that the distances between adjoining apertures (3) on a rail (1) be equal throughout the entire length thereof (1). During operator installation, the apertures (3) of one rail (1) must be made to exactly oppose—or be directly in horizontal alignment with—those of the other (1). A plumb line and level should be employed to assure such alignment.

Figure 12:
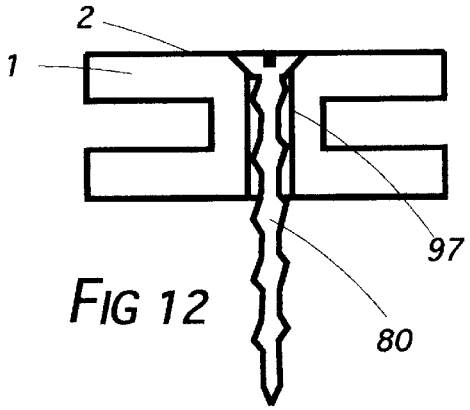
FIG. 12 is a cross sectional view of a guide rail (1) illustrating its (1) connection to a wall or other supporting structure.

When installed upon a wall (106) or door (100), ante, the rails (1) are disposed in identically oriented parallel disposition, as that term is defined supra. For door jamb (104) installation, however, they (1) comprise facially opposing disposition. Screws are typically employed as rail attaching fasteners driven into the underlying surface through the rail (1) at several points along its (1) length. For most wall (106) or door jamb (104) installations, where penetration through solid backing such as wooden studwork is involved, attachment is suitably made by a wood-threaded mounting fastener (80), even when run through a smooth walled fastener aperture (97), as shown in FIG. 12. However, where the assembly is anchored to backing such as metal studs, screws must either comprise a self-tapping character or be otherwise manufactured for adequate gripping. Whatever its (80) form, to avoid obstructing the passage of rail sliding receptors (7) discussed ante, any assembly fastener (80, 82) impaling—that is, passing through—the rail (1) should be flat-headed and the apertures (97) through which they (80, 82) are driven, countersunk.

Next introduced as part of the invention is a height adjusting pulley tethering assembly (4) comprising a horizontally disposed crossbar (5) and pairs of acentric pulley ssemblies (19) and rail sliding receptors (7) for each bar (5). The sliding receptors (7) comprise bar emplacement sockets (12) into which (12) the bar (5) is extended as further discussed ante. For installation upon a wall (106) or upon a door's face (101), stop rings (39) held in place with set screws (40) are preferably disposed at each of the crossbar ends (6).

The height adjusting feature permits the operator (200) to raise and lower the tethering assembly (4) to a height selected for a particular set of exercises. For example, upon setting the assembly (4) at a high level upon the rails (1), the operator (200) may engage those muscles applied to downward pulling. Adjusting (4) to mid-level enables forward thrusting motions much in the manner undertaken by a boxer. When lowered toward the bottom, the assembly (4) permits either upward pulling motions by a standing operator (200) or forward thrusts by one (200) seated upon the floor (107). It should be recognized that an infinite number of intermediate settings provide feasible selections offering exercising nuances preferable in one case or another.

Each rail sliding receptor (7) comprises a face (9), disposed outwardly toward the operator (200), a rail engaging underside (8) disposed toward the rail (1) opposite the face (9) and upon which rail engaging lips (11) are disposed, two opposing lateral sides (10), a retractable spring loaded pin latch assembly (14) and a latch spring thrusting shoulder (29), all of which are further discussed ante.

Figure 8:
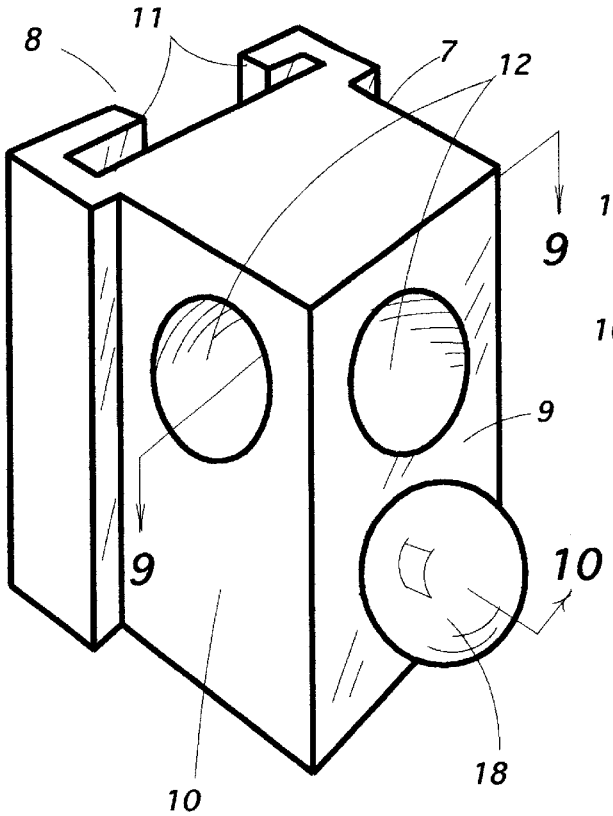
FIGS. 8 and 9 represent a rail sliding receptor (7) shown in both perspective and cross sectional views.
Figure 9:
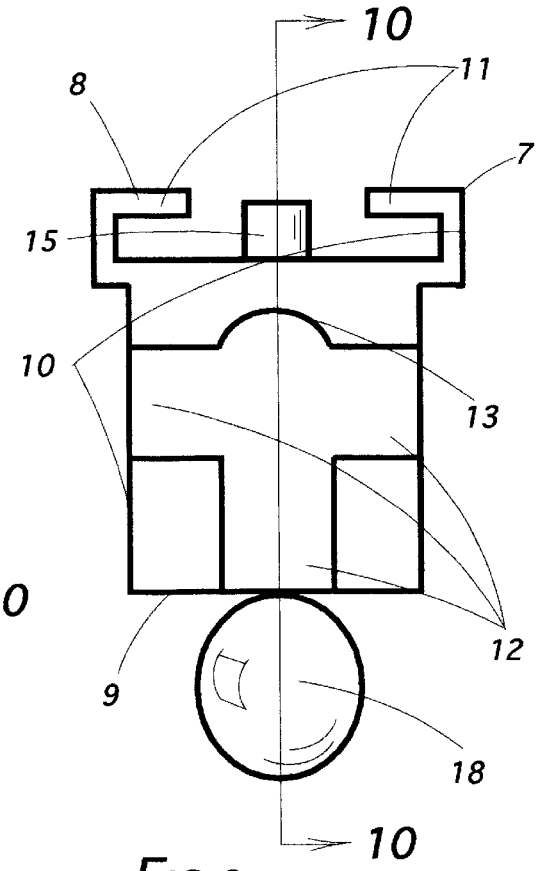

The rail engaging lips (11) referred to supra are shaped to fit the guide rails (1) reasonably snugly. Thus, if the rails (1) comprise the preferred "I" beam configuration, having a cross section approximating the shape of the letter "I", the rail engaging lips (11) similarly have a cross section comprising an opening of that same shape, as shown in FIGS. 8 and 9. The rail sliding receptor (7) is prevented from dislodgement from the rail (1) because the lips (11) are stopped by the flared protrusions, simulating those of the letter "I", disposed at the outer face of the rail (1). While "I"beam configuration is preferred, supra, it is contemplated that any of a considerable number of rail (1) configurations may be employed in construction, so long as the rail engaging lips (11) are mated to it (1) and shaped to provide a dislodgement stop.

The rail sliding receptors (7) are so comprised that they may be employed in applications other than exercise assemblies, such as for industrial use, so long as those other applications include a pair of guide rails (1) to which the receptors' (1) undersides (8) are mated. The receptors (7), thus, comprise quick and easy means to adjust the position of any structure situated upon such rails (1). If the receptors (7) are interconnected and overlain by another structure supported thereby, such as might be the case in industrial application, they (7) may be used in cooperation with one another (7) to adjust the structure's position along the rails (1).

The horizontally disposed crossbar (5) comprises rod-like elongation circular in cross section, to which the shape of each bar emplacement socket (12), supra, conforms, although comprising slightly larger diameter.

The bar (5) penetrates and, in other than door jamb (104) installation, preferably passes through each of the opposing lateral sides ( 10) of the sliding receptor (7). In other than door jamb (104) installation, the crossbar (5) may be conveniently employed at its (5) manufactured length, thereby obviating any cutting. When the crossbar ends (6) are allowed to extend outward beyond the receptors (7), the installing operator (200) is provided a range of selection for the span between rails (1).

For any installation in which a bar end (6) is permitted merely to seat within the receptor (7) rather than being disposed to pass completely through it (7), only the more interior or inboard oriented laterally disposed sockets (12) are required.

As a mechanical stress relieving feature, for the sake of interchangeability of parts and to provide the operator (200)

assembly set-up versatility, the sockets (12) should be manufactured to join one another (12) within the receptor (7), thereby disposing them (12) to tunnel laterally through it (7) from one side (10) to the other (10).

As with many other mechanical assemblies, some play—that is, a tolerable looseness in connection—should be provided for. Rail (1) installation should be reasonably precise, but to allow for some degree of inaccuracy in attempting to align to the perfectly parallel, a connection of the crossbar (5) straight through the sockets (12) provides a distinct advantage.

In straight-through crossbar (5) embodiments, a stop ring (39) secured by a set screw (40), supra, is emplaced proximate each end (6) of the bar (5), serving as a retaining stop to prevent it (5) from become unseated during use. It is preferable to allow approximately ¼ inch of space between the receptor's outer side (10) and the stop ring (30). Experience demonstrates that a margin of such dimension accommodates slight misalignment in rail disposition without impairing the assembly's operation. Such allowance affords a degree of play, without which difficulty might be encountered in attempting to slide the height adjusting assembly (4) any significant distance along the rails (1).

As further discussed ante, one or more pairs of acentric pulley assemblies (19) are emplaced upon each bar (5) with a length of elastic exercise cord (27) strung through each (19). The elastic cord (27) is part of the pulley assembly's operator tension manipulating assembly (26), further discussed ante, and extends outward from the invention with one type or another of an operator tension manipulator (28) disposed thereon.

Operation of the height adjusting pulley tethering assembly (4) is accomplished by manipulating a pair of retractable spring loaded pin latch assemblies (14), each comprising a latch spring (16), preferably of a coiled variety; latch handle (18); and guide rail aperture engaging pin(15) comprising in turn a latch spring retracting shoulder (29). Upon the assembly's (4) height adjustment by the operator (200), each pin (15) is sharply snapped into a selected one of the guide rail's spaced latching apertures (3) and retained in place therein (3) by expansion of the spring (16) between the pin's spring retracting shoulder (29) and the rail sliding retractor's spring thrusting shoulder (17).

Figure 10:
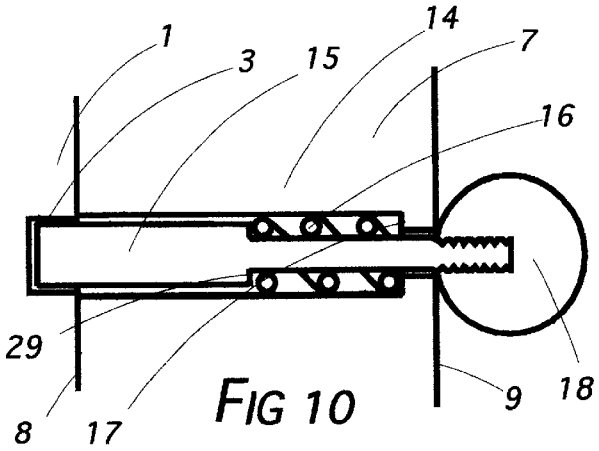
FIG. 10 comprises a cross section of a rail sliding receptor's (7) retractable spring loaded pin latch assembly (14).

As illustrated in FIG. 10, the configuration of the interior wall of the rail sliding receptor (7) is such as to permit the spring (16) to bear against it (7) in compression as the pin (75) is forcibly retracted or withdrawn from the aperture (3). Then, upon the operator's (200) release of the handle (18), the spring (16) expands, impelling the pin (15) to engage any underlying latching aperture (3) and seat itself (15) therein (3). The thrusting energy required for latching engagement and retention is stored within the spring (16) during its seated retraction against the receptor's (7) inner wall. That seating site is designated herein as a spring thrusting shoulder(17) an immobile element of the invention which, as mentioned supra, is characterized as being comprised by the receptor (7). The other seating shoulder, the mobile retracting one (29), is comprised by the aperture engaging pin (15).

The assembly's latch handle (18), preferably comprising knoblike configuration, is shaped to provide a convenient handgrip for the operator (200) in making the adjustment.

A spring loaded latch assembly (14) is particularly useful in the invention's employment in that it (14) permits rapid adjustments to be made to a key part of the operational system. The span between the rail frames (44) is sufficiently small to permit the operator (200) to use both hands in repositioning the entire height adjusting assembly (4) in one continuous effort. Once the adjustment has been made, the assembly (4) is held in place by rigid emplacement, as that term is employed herein.

At one end of the acentric pulley assembly (19) mentioned supra, the pulley assembly's tethering terminal (20) comprises a crossbar tethering leg (21) which in turn comprises a tethering ring (22) of carefully prepared inner diameter, a bar tethering leg axle pivot (23) and an acentrically projecting foot (34) further discussed ante. The tethering leg (21) comprises either single leaf (121) or double leaf (221) structure, further discussed ante. The other end of the acentric pulley assembly (19) interconnects with the operator tension manipulating assembly (26). The latter assembly (26) includes the length of elastic exercise cord (27), supra, as well as operator tension manipulators (28) which comprise handgrips, foot straps, a head and neck harness (31) or any sort of tension manipulator belt or loop. A variety of straps, for example, may be employed to form connecting loops to some part of the operator (200) including the ankles, thighs, waist or torso in general.

The point at which the manipulating assembly (26) interconnects with the height adjusting one (4) comprises that at which the exercise cord (27) seats within the circumferential groove (36) of a pulley wheel (35) further discussed ante.

Figure 2:
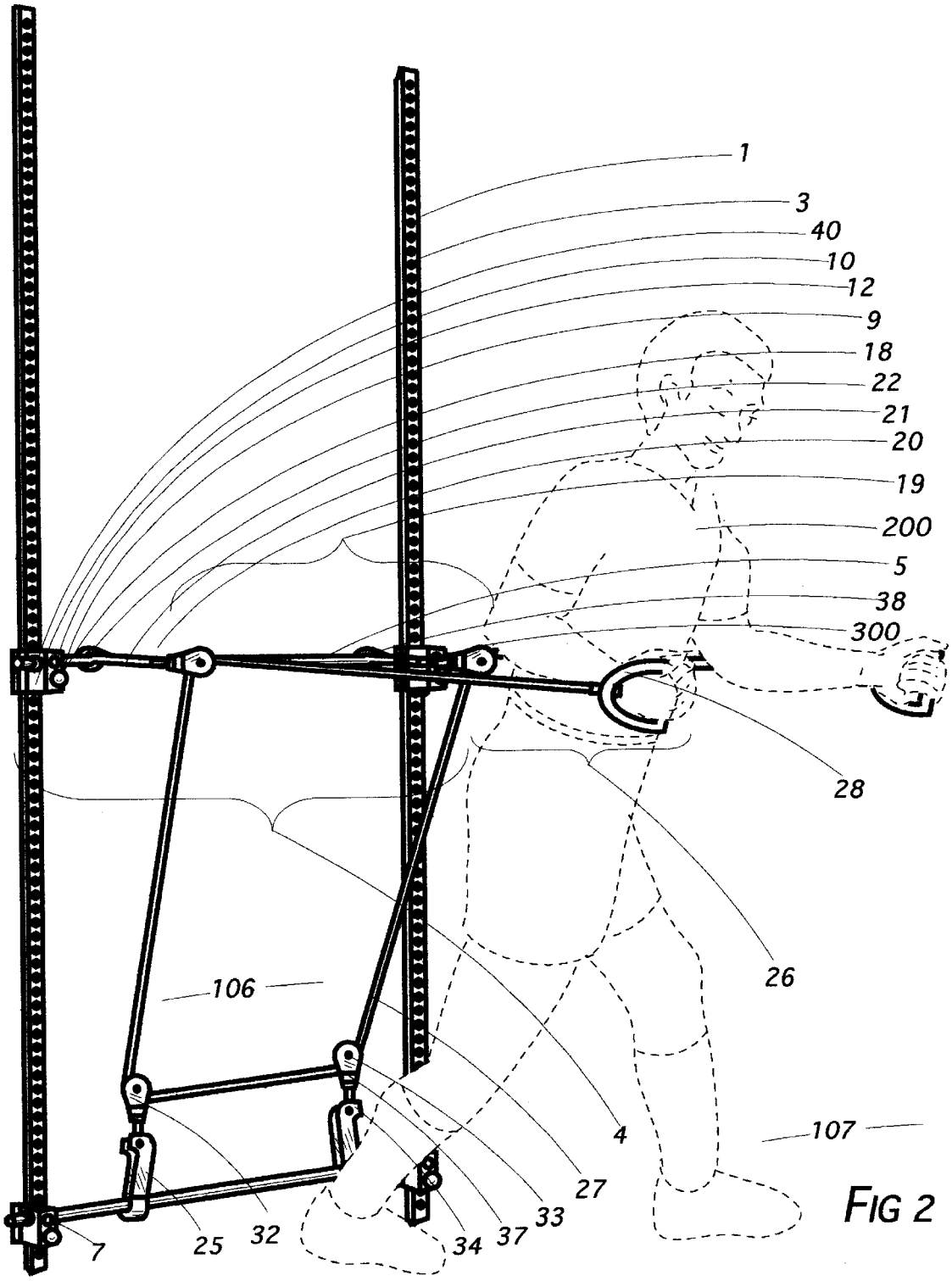
Figure 3:
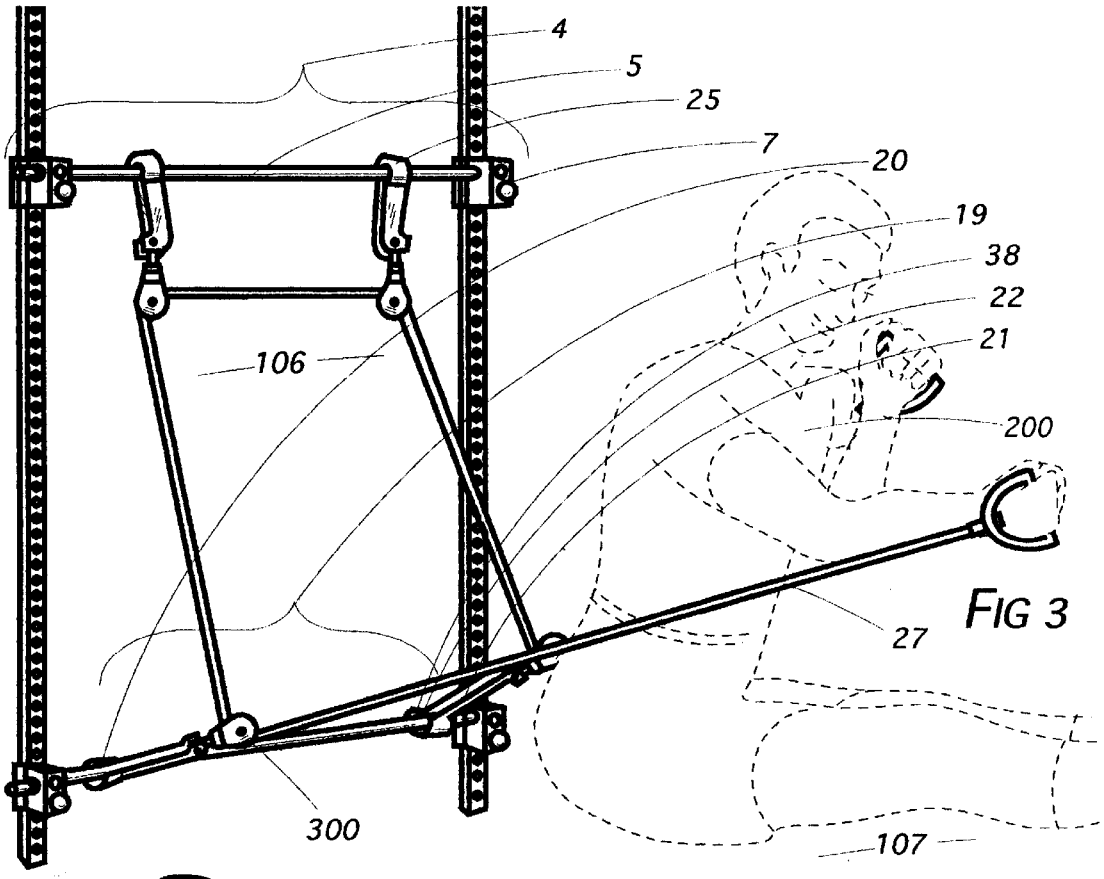

It should be recognized the pulley assembly (19) comprises four distinct axes of rotation. A first one inheres in the fact that the tethering ring (22) encircles the crossbar (5) at least in part, further discussed ante, and rotates freely upon it (5) in a vertical plane. Therefore, the assembly's tethering leg (21), with which the ring (22) shares one-piece construction, may be oriented upwards or downwards or in any intermediate position to permit tethering selections offered by raising or lowering one or more of the crossbars (5). As FIGS. 1–3 show, the tethering legs (21) point downward when the bar (5) is emplaced at a high level relative to the operator (200), upward when it (5) is emplaced at a low level and outward horizontally when emplacement is intermediate along the rails (1).

A second axis of rotation, transverse to the first, is provided at the tethering leg's foot (34), to which the swivel (24) is connected by means of axial transversion, as that term is identified supra. Within certain limits, the swivel (24) swings freely from an Interleaf axle pivot (23) thereat, defining a substantial part of a second plane of rotation. The swivel's (24) rotation may be provided for in at least three ways. The interleaf axle pivot (23) might be disposed in traditional style to spin freely within both the swivel and opposing seating sites upon the tethering leg (21); the pivot (23), attached at its (23) seating sites may merely provide an axle for the swivel (24) to rotate upon; or the swivel itself (24) may comprise a "T" shaped end, the trans verse portion of which is permitted to spin freely within the seating sites. All of those embodiments provide a second axis of rotation and permit the same manner of swivel (24) movement.

A third axis is provided by the swivel's (24) engagement with the pulley axle frame (32). The swivel (24), generally stem-like in configuration, is disposed in manufacture to pass through a hole in the frame (32). While it (24) comprises a widening or cap at its (24) frame engaging end to prevent its (24) being withdrawn therefrom (32), it (24) is configured to assure unobstructed rotation or free spinning therein (32). The plane of rotation is transverse each of the others.

Still a fourth axis comprises the pulley wheel's (35) disposition upon its (35) own pulley axle (33). Rotational movement at this axis is, preferably, further enhanced by configuring the axle (33) so that it (33) is permitted to rotate or spin within the frame (32) instead of being solidly attached to it (32). This fourth axis provides an additional transverse plane of rotation.

The entire assembly (19) is, thus, easily capable of reorientation in any of the three dimensions. All axes of rotation can be visualized by observing the assembly (19) depicted in FIG. 4.

The operator tension manipulating terminal (25) of the exercise assembly comprises the situs at which a portion of the exercise cord (27) anchors to it. This point (25) comprises the ultimate terminus of force during the invention's use and, as mentioned elsewhere herein, should not be confused either with the exercise tethering point (300) or a pulley assembly's tethering terminal (20). The manipulating terminal (25) may comprise a single point disposed more or less as a vertex from which the midpoint of the exercise cord (27) extends. This arrangement would, for example, concur in an assembly setup in which a single hook serves as an anchoring site at such a connection vertex. A similar arrangement might also be comprised in a single pulley assembly (19). More often, however, a pair of pulley assemblies (19) are disposed to comprise the operator tension manipulating terminal (25) as in FIGS. 1–3, wherein the terminal (25) comprises the span between the two anchoring pulley assemblies (19) as opposed to either of them (19) independently.

As the terminology suggests, the axle frame (32) comprised by the acentric pulley assembly (19) in part comprises an axle (33) upon which the wheel (35) is axially mounted to allow it (35) to spin. The axle frame (32) is configured with a lateral access elastic cord emplacement gate (37), comprising an opening of width sufficient to allow passing the elastic cord (27) through it (37) when the cord (27) is operably stretched expressly for that purpose so as to temporarily narrow its (27) diameter. Once so admitted within the frame (32), the cord (27) is emplaced and seated within a circumference groove (36) comprised by the pulley wheel (35), permitting its (27) retention while circumnavigating the wheel (35) during exercise.

Figure 4:
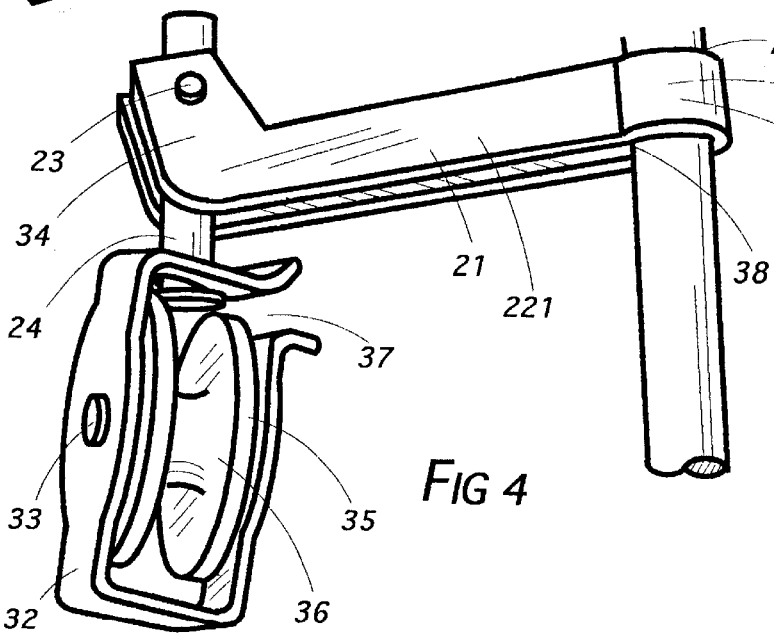
FIG. 4 is a perspective view of an acentric pulley assembly (19) of double leaf tethering leg configuration (221) illustrating four separate pivoting points thereon and including members which confer the effect of acceleration varied virtual diameter (38) upon the assembly (19). The assembly better demonstrates those features by being shown tilted such that the horizontal crossbar (5) is oriented vertically therein.
Figure 5:
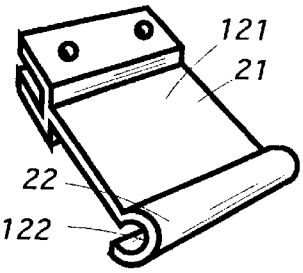
FIG. 5 illustrates a single leaf leg (21, 121) embodiment.
Figure 6:
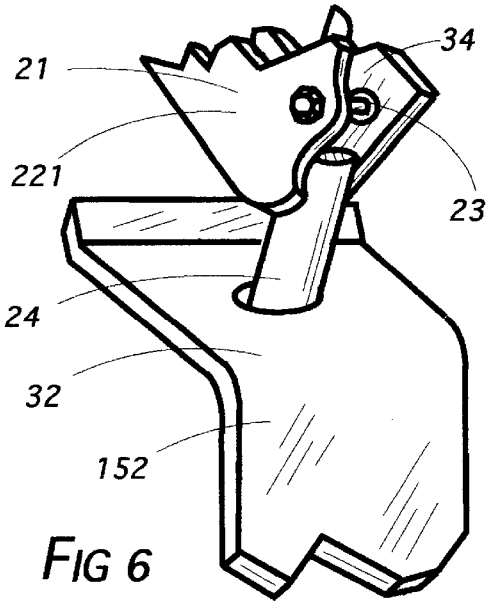
FIGS. 6 and 7 depict a tethering leg pulley swivel's (24) interconnection between a bar tethering leg (21) and a pulley axle frame (32) one view in perspective with part of both the tethering leg (21) and the pulley swivel (24) cut away for viewing purposes, the other in cross section.

Embodiments of bar tethering legs (21) are shown most clearly in FIGS. 4 and 5, although they (21) are also present in one form or another in FIGS. 1–3. That depicted in FIG. 4, comprising double leaf structure (221), permits operator (200) hand tool impingement manipulation, such as with a pair of pliers, to adjust mechanical tension upon the tethering leg pulley swivel (24) at the leg's interleaf axle pivot (23). From that point of view, it (221) is a preferred construction. However, experience as demonstrated that a pin tethering leg (21) of the single leaf configuration shown in FIG. 5 (121) can be formed by extrusion and is, therefore, more economical to manufacture.

The pulley assembly's tethering ring (22) comprises configuration attributable to either respective structure (121, 221). Double leaf configuration (221) may comprise a continuous cylindrical ring (222) depicted in FIG. 4. Even in this embodiment, the ring (22) is not usually complete because it is convenient in manufacture to allow a small separation consistent with the paired or doubled leaves. A single leaf configuration (121) embodiment would well accommodate a cylindrical ring (22) which completes the circle. However because the extrusion process referred to supra requires special configuration, it preferably produces a truncated cylindrical ring such as that shown in FIG. 5. However, either configuration (121, 221) may comprise an encircling ring (22) which is either partially or substantially enclosing (122, 222, respectively), as those terms are defined, supra, the truncated or partially enclosing (122) embodiment being shown in FIG. 5. Whichever tethering leg (21) embodiment is presented, each (121, 221) comprises an opening to accommodate connection of the pulley swivel (24) by means of the interleaf axle pivot (23) as shown in FIGS. 4 and 5.

The crossbar tethering leg (21) at the pulley assembly's tethering terminal (20) comprises acentricity which lends the pulley assembly (19) considerable convenience in use. The inner diameter of the pulley's tethering ring (22) must be greater than the outer diameter of the horizontal crossbar (5) it connects to, whatever the degree of encirclement might be. The difference provides the ring (22) and bar (5) with slight looseness of fit which must be sufficient to permit the ring (22) to be slid freely upon the bar (5).

However, the bar tethering leg (21) is configured so as to cause the assembly (19) to be pulled off center when, by reason of exercise, the operator (200) tugs laterally upon the elastic cord (27) and, therefore, upon the pulley assembly itself (19). The tethering leg (21) accordingly comprises an acentrically projecting foot (34) which is a structural extension out of alignment with—that is, off center from—the assembly's (19) longitudinal centerline. The tethering leg's Interleaf axle pivot (23) is disposed at a point within the foot (34), which may take any one of several shapes so long as it (34) diverges, displacing the axle (33) off center.

The orientation of the pulley frame's acentrically projecting foot (34) determines the AVVD's (38) orientation. Since the tethering leg (21) is not provided with any turning means with respect to the tethering ring (22), it (21) is not permitted to itself (21) revolve against or with reference to the ring (22). Thus, the orientation of the acentrically projecting foot (34) remains unchanged following assembly.

When two pulley assemblies (19) are operated in conjunction with one another (19), a first one (19) for the right arm or leg and a second one (19) for the left—the operator's (200) tugging efforts are directed inwards—one assembly (19), therefore, being directed to the right, the other (19) to the left. In such case, therefore, in order to assure a correct AVVD (38) effect, the leg's projecting feet (34) must upon operator (200) assembly, both be oriented outwardly toward the crossbar's ends (6), one of them (34) pointing to the right, the other (34), to the left.

A tug in the direction the foot (34) is pointed merely slides the tethering ring (22) along the bar (5) more or less unimpeded by friction. However, upon tugging against the pulley assembly (19) somewhat laterally in the opposite direction, the leg (21) and, therefore, the tethering ring (22) cannot be made to slide any significant distance. By reason of the acentricity of the frame's (32) structure and the ring's (22) slightly loose fit upon the crossbar (5), the ring (22) and, therefore, the leg (21) with which it (22) is joined in one-piece unified structure, tilts slightly.

The phenomenon by which the ring's (22) tilting occurs when pulling upon the assembly (19) in one direction but not in the opposite is due to the location of the application point—that is, the locus at which the leg (21) connects to the pulley swivel (24) extended in the direction pulled by the cord (27)—with reference its (21) longitudinal centerline. When the point lies on the side representing the direction to which the effort is applied, no levering or fulcrum can be applied at the bar (5). Sliding will continue until the assembly (19) reaches a point of alignment with the operator's (200) effort. Less force is, therefore, required to move the ring (22) laterally than to tilt it (22) into bar (5) impinging position.

When the point lies on the opposite side of the centerline, fulcrum force is applied against the bar (5) and tugging upon the assembly cannot change the ring's (22) position. Less force is required to tilt the assembly (19) into such bar (5) impinging disposition than to move it (19) along the bar (5).

The effect produced once tilting occurs is not readily understood, although there are many examples of its mechanical application in prior art. Although the slight tilt of the ring (22) when tugged laterally can obviously have no effect upon the ring's (22) actual inner diameter, an inherent manufactured property thereof (22), it nevertheless reduces the inner diameter of the ring (22) with reference to the crossbar (5) in an effectual or virtual manner. Upon virtual reduction of diameter, the ring (22) begins to grip the bar (5), the grip tightening as the force of the tugging effort referred to is increased. As the tugging force is released, however, the virtual diameter of the ring (22) is returned to its previous state, once again allowing it (22) to slide freely upon the bar (5).

It should be understood in these matters that while such tugging is often partly downwards or upwards, depending upon the height of the tethering point (300), there is always a horizontal component directed parallel the bar (5). Under those circumstances, the assembly (19) becomes effectually locked in place on the bar (5) and is prevented even from seeking operator (200) alignment. As a result, the operator (200) may selectively set the assembly's tethering points at a point along the bar (5) most suitable for a given exercise and engage in it without concern that the assembly (19) might wander from the selected tethering point (300).

Since the virtual diametrical reduction effect (38) is produced by the operator's (200) lateral tugging—that is, a lateral acceleration—it is designated herein as acceleration varied virtual diameter (AVVD) (38). It is generally recognized that gravity is merely a special case of accelerated forces. Examples of the effect (38) where gravity is the accelerating factor (GVVD) are mentioned supra in the Background of the Invention section of this application. It is important during exercise that the AVVD (38) effect permit tugging upon the elastic cord (27) during exercise so as to provide a secure tethering point (300) during use. It would be counterproductive to proper exercise if the pulley assemblies (19) were allowed to slide back and forth once a tethering point (300) is AWD (38) secured by initial exercise effort.

The acentric pulley assembly (19) is so comprised that it (19) may be employed in applications other than exercise assemblies, such as industrial, agricultural or other commercial enterprise, so long as those other applications include a horizontal crossbar (5) upon which its (19) tethering ring (22) can be emplaced. Thus, the assembly's operator tension manipulating terminal (25) may address task-performance other than exercise.

While, as mentioned, the invention may be installed upon a wall (106) or within a door jamb (104), if desired, it lends itself well to installation upon a door's face (101) without marring the surface of the door (100). All of the wall (106) mounted exercise assembly arrangements illustrated in FIGS. 1–3 are appropriate also for door (100) mounting. In the latter case, however, additional invention components are required.

To that end, the invention features to complement each guide rail (1) a mounting channel (41). The rail (1) overlies this structure (41) longitudinally and is firmly attached to it (41) comprising the combination made thereby a rail frame (44). The guide rail (1) is secured to the mounting channel (41) by means of machine-threaded interconnecting fasteners (82) each of which passes through a smooth walled fastener aperture (97) disposed in the rail (1) and penetrates to begin interthreading with the machine-threaded interconnecting aperture (98) of a retracting plate (99). As the fastener (82) turns, the plate (99) is urged to turn with it until it contacts a turning stop(96) disposed within the mounting channel (41). Once the plate (99) is thereby forced against the stop (96), interthreading occurs, forcing the retraction plate (99) tightly against the channel's lip ridges (43) as shown in FIG. 10. The connection is, thus, sometimes said to be capable of being made "blindly", obviating the difficulty otherwise presented by a freely turning plate (99). Tightening of the fastener (82) and plate (99) is thereby made feasible without securing the latter (99) with an additional tool. Appilcant claims no inventive property in this fastener assembly itself, now an established feature of prior art and commercially available. For the same reasons considered in connection with the wood-threaded fastener (80) used for wall (106) installation, the rail (1) and channel (41) interconnecting fastener (82) should also be flat headed.

The mounting channel (41) of the commercially available and preferable form comprises a trough or flattened "U" shape configuration, the closed flat part thereof (41) mounted upon a household door's face (101).

Figure 14:
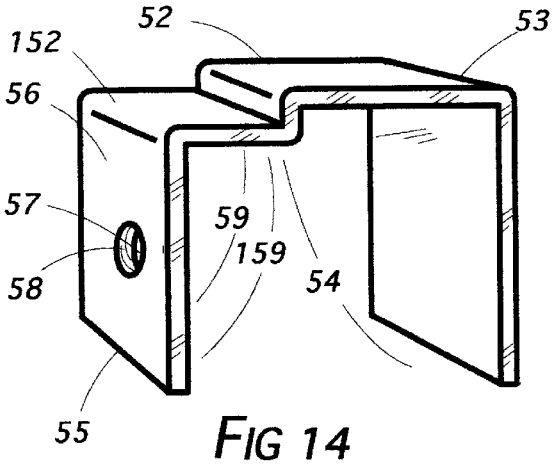
FIGS. 14 and 15 comprise perspective views of a multiply embowed door connecting bracket (52) exhibiting millwork clearance, door edge wrapping and retracting plate configuration (159, 54, 59, respectively), the latter of the drawings showing the connecting site of the bracket's tongue (56) with the rail frame (44).
Figure 15:
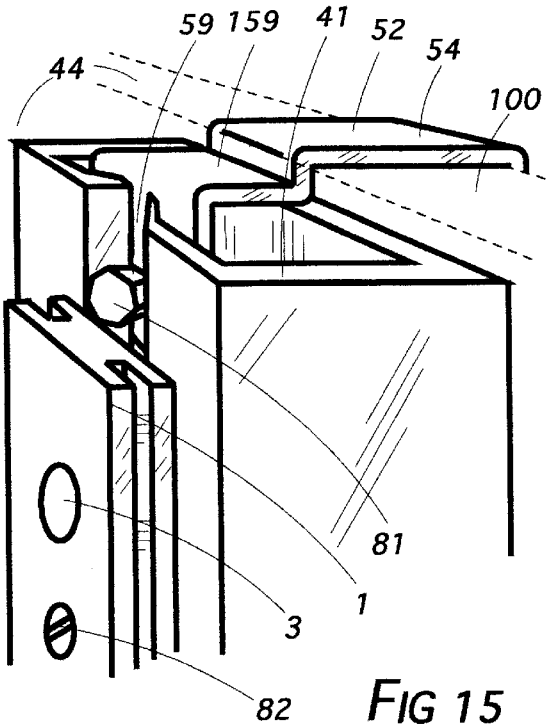

For assembly as intended upon a door face (101), two pairs of surface protecting door connecting assemblies (50) are employed, disposing door connecting brackets (52) upon the door (100), two at the top thereof (100) and two, the bottom, respectively. The disposition is such that one (52) is emplaced at each end of each rail frame (44). Each uppermost bracket (152), shown in FIGS. 14 and 15, is elbowed to conform, when emplaced, snugly to the edge (102) of the door (100) at its (100) top, to provide clearance required for any millwork installed within the doorway (103) at the top. This embodiment is, therefore, stated herein to comprise doorway millwork clearance configuration (159).

Figure 16:
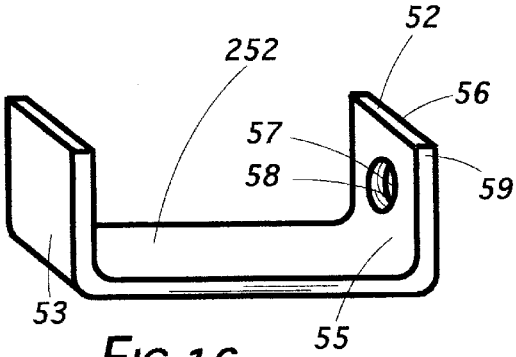
FIG. 16 depicts a perspective view of a straight projectioned door connecting bracket (152) exhibiting retracting plate configuration (59).

This configuration feature (159) is only relevant to installation of the exercise assembly upon an inwardly closing door face (101). If such millwork were absent or if installation were upon the opposite outwardly opening door face (101), two of the elbows could be omitted in manufacture and only one configuration for the bracket pair (252) would be required. An embodiment comprising such less multiply elbowed configuration—or straight projectioned configuration (252), as it is referred to herein—is shown in FIG. 16 and is intended for use at the foot of the door (100), where otherwise interfering millwork is generally absent.

In fact, however, although not essential to function, the additional elbows enhance the assembly's security by reason of the additional surface thereof snugly in contact with the door (100). This observation suggests a preference that the multiply elbowed bracket (152) be employed at both of the door's (100) ends. A bracket so shaped (152) is stated herein to comprise door edge wrapping configuration (54). Thus, the bracket depicted in FIG. 14, (151), comprises configuration both of the doorway millwork clearance (159) and the door edge wrapping (54) sort. Experience has shown that where the concern is only for the assembly's anchoring and not for millwork clearance, security is adequate without the inclusion of such a bracket (152).

Specifically, the part of the multiply elbowed bracket (152) fitting the door's edge (102) is designated the door bracketing end(53) thereof (152). As shown in the drawings, two sharp bends are required to provide it (152) with the door edge wrapping configuration (54) alluded to supra.

That bracket's (152) other end is designated the rail frame emplacement end (55). It (55) comprises a tongue (56) which upon assembly installation is extended into the mounting channel's end (42).

Figure 13:
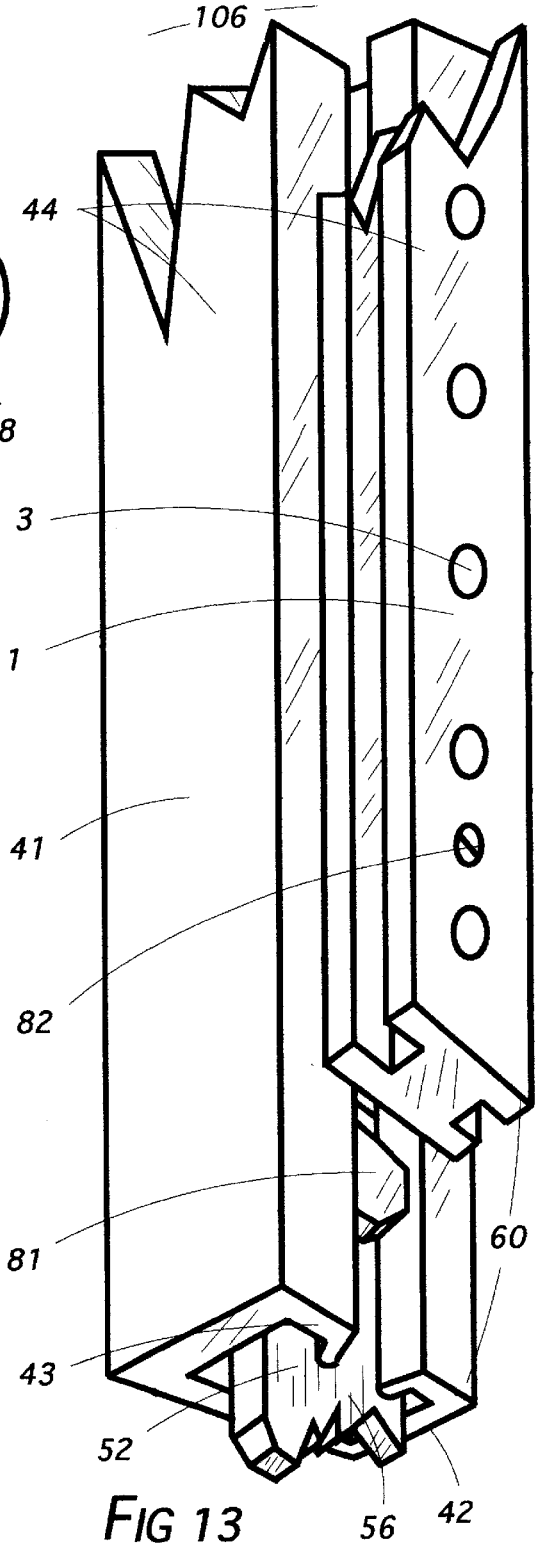
FIG. 13 is a perspective view of a rail frame end (45) demonstrating disposition of a retracting bolt (81) as well as adjusting clearance (60) therefor.
Figure 17:
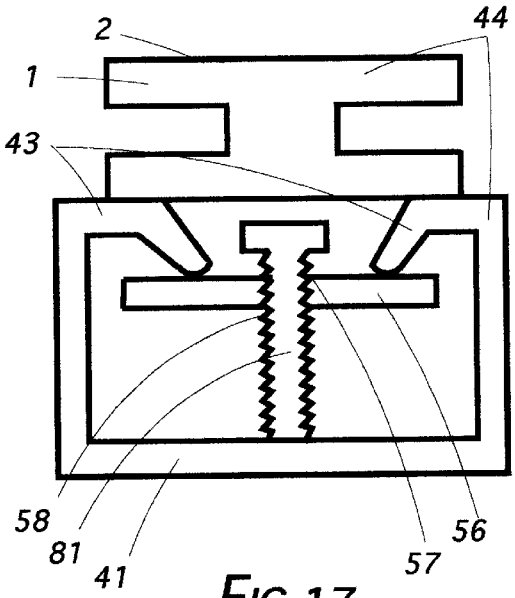
FIG. 17 is a cross sectional view of a rail frame (44) illustrating the connection between rail (1) and mounting channel (41) as well as that of the frame (44) with a door connecting bracket tongue (56) by means of a retracting bolt's (81) contact against an interior wall of the channel (41).

The tongue (56) comprises a machine-threaded retracting bolt aperture (57) through which a retracting bolt (81) employed to attach the rail frame (44) to the door (100) is inserted or passed. Access is provided for bolt (87) adjustment by configuring each rail frame end (45) with a retracting bolt adjusting clearance (60), as shown in FIG. 13. As the bolt (81) is operably turned against the aperture threads (58), it (81) impales the tongue (56). The tongue (56) is secured by retraction of the bolt's (87) threads against those (58) of the tongue's aperture (57) upon its (81) inability, as the two (81, 58) interthread, to advance by reason of its (81) contact with the impenetrable interior wall of the channel (47) disposed proximate the door's face (107). The threads of the bolt (81) are mated to the tongue's aperture threads (58). Thus, once the bolt (81) can no longer advance because its penetrating end has contacted the channel's (41) interior wall toward which it advanced, as shown in FIG. 17, any urging of its (81) turning effectuates retraction. Expansive pressure is thereby exerted against both the aperture threads (58) at one extreme and part of the interior surface of the mounting channel (41) at the other. Specifically, as pressure is increased by further turning of the bolt (81), the bracket's tongue (56) is squeezed outward against the channel lip ridges (43), thereby tightly urging the channel (41) against the door's face (101) via the strong channel (41)—bracket (52) connection. The effect, well understood in prior art, is similar to that exhibited in some drapery rod assemblies.

It is preferable that the mounting channel's lip ridges (43) comprise curls or angular protrusions at the edges of the channel (41) the tongue (56) is urged against, as shown in FIGS. 11, 73, 15 and 17. That feature localizes the point of retraction contact, thereby strengthening the attachment.

Since the mounting channel (41) is "U" shaped, the inwardly curled lip ridges (43) are by inherent configuration disposed to be displaced outward away from the door and from the flattened innermost part of the channel (41)—the part in contact with the door's face (101). Proper retraction by the tongue (56) requires that upon insertion into the channel end (42) it (56) be disposed proximate the lip ridges (43). As shown in FIGS. 13 and 15, the bracket (52) exhibits what is designated herein as retracting plate projection configuration (59)—that is, it (52) is disposed and configured to facilitate retraction, supra.

What has been explained concerning the retaining power of the multiply elbowed bracket (152) is also true of the bracket (252) optionally employed at the bottom of the door (100). While that bracket (252) is configured with two fewer elbows than the uppermost one (152), those it (252) does, nonetheless, provide the same connecting strength those of the upper bracket (152) do. Both of the two brackets (152, 252) share in comprising an elbow which upon emplacement disposes a portion of the door bracketing end (53) to seat snugly across the edge and against the face (101) of a household door (100) opposite that (101) of the exercise assembly's installation and are, therefore, said to bracket the door's edge (102). It should be recognized that the door bracketing end (53) is elbowed to provide a backing plate or anchor of support for the assembly. It should also be observed that both configurations (152, 252) comprise retracting plate configuration (59).

Experience demonstrates that even where the doorway millwork mentioned supra is present, there is usually sufficient clearance for the inherent single thickness of the portion of the door bracketing end (53) disposed against the door face (101) opposite that of assembly installation. That is—when the door (100) is shut, it (100) and any millwork present would be sufficiently spaced apart so as to avoid impinging upon any portion of the bracket (52). In the rare instance such should not be the case, the millwork strip would preferably be moved to provide the space required.

It should be apparent that in order for the bracket (52) to provide the strength required to engage the ridges (43) effectively and the slight flexibility required for retractability upon interthreading, care be exercised in selecting the manufacturing materials. Many of the parts of the invention are preferably manufactured of an aluminum alloy which exhibits a pleasing shine. It is of such metal that the commercially available rail (1) is constructed. Because of the demands required of the door connection bracket (52), however, a suitable metal is preferably employed for it (52)—a stainless steel alloy with some spring properties, for example. The commercially available mounting channel (41) is also usually comprised of steel.

Figure 11:
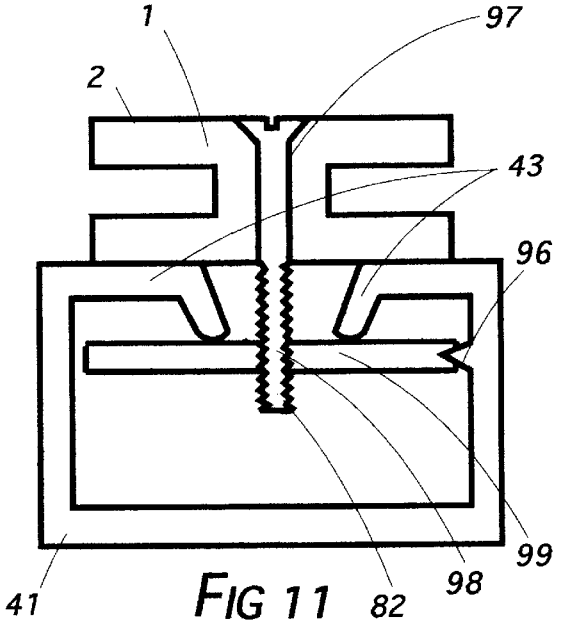
FIG. 11 is a cross sectional view of a rail frame (44) illustrating the connection of a rail (1) to a mounting channel (41) by means of a retracting plate (99).

While it would be otherwise feasible to interthread a nut on the side of the tongue (56) opposite the point of the bolt's (81) entry, such as might be done as a substitute for the retracting plate (99) in the FIG. 11 arrangement, the retracting action illustrated in FIG. 17 obviates doing so. The latter means of firmly securing two interthreaded objects is useful in situations in which a tool's spacial access to a fastening site is considerably limited.

The use of a surface protecting door connecting assembly (50) is not limited to exercise assemblies but may be employed, for example, to support various weight bearing hanger systems. It (50) may be employed in any application in which surface protective emplacement upon a door's face (101) is required, so long as a rail frame (44) comprising in part a mounting channel (41) is provided.

We have now encountered three types of connectors relating to the invention's installation. The first is the wood threaded mounting fastener (80) to secure an exercise assembly to a wall (106) or within a doorway (103). The second is the machine threaded retracting bolt (87) required to attach the channel (41) to the door face (101). The third is the machine threaded interconnecting fastener (82) employed to attach the rail (1) to the channel (41) also in door face (101) installation. Because no screw or like fastener (80) used for wall (106) installation is required for door face (101) installation, the interconnecting fasteners (82) may be run through the same holes in the rails (1)—the smooth walled fastener apertures (98)—otherwise dedicated for the former (80).

In an alternative assembly, as observed in some cases in prior art, the invention may be installed within a doorway (103). As in wall (106) installation, door connecting brackets (52) and mounting channels (41) are excluded. In this installation, one guide rail (1) is attached directly to each jamb (104)—that is, the vertical portion of the perimeter of the opening—each (1) thereby in facially opposing orientation.

In door jamb (104) employment, it is usually preferred that when the exercise assembly is not in use all of its parts except the guide rail itself (1) be dismantled so that obstructions to traffic through the doorway (103) are reduced. In order to overcome a problem of insufficient clearance otherwise present in door jamb (104) assembly during attempted emplacement and removal of the height adjusting pulley tethering assembly (4), the rails (1) must be cut to a length a few inches shorter than the jamb (104) before attachment to it (104).

Configuring the rails (1) in this manner creates a receptor emplacement gap (85). Although the gap (85) may optionally be disposed proximate either end of the guide rail (1) pair, to maximize usable rail (1) length and for reasons of aesthetics, it is preferable to dispose the gap (85) at the bottom, rather than at the top. The gap (85) is made sufficiently large—about three to five inches—to provide sufficient clearance for the assembly.

For the same reasons inherent in door jamb (104) mounting, however, it is necessary to provide for a receptor emplacement gap (85) in any wall (106) installation in which the rails (1) extend all of the way to the ceiling.

To accommodate installation within the doorway (103), the facially opposing rail sliding receptors (7) comprise bar emplacement sockets (12) which penetrate the receptor's face (9) without tunneling completely through to the receptor's rail engaging underside (8). All of the operator's (200) assembly options may be accommodated if the receptor (7) is configured in manufacture with sockets (12) both upon its face (9) and in lateral opposition upon the sides (10). All three (12) may be disposed to tunnel and intercept one another (12) as suggested with reference to those (12) disposed in the receptor's sides (10) supra.

In assembly either upon a wall (106) or a door's face (101), the length of the crossbar (5) may be permitted to vary somewhat because adjustments may be made in placement of the guide rails (1) or the rail frames (41). In doorjamb (104) assembly, the crossbar (5) is emplaced to extend from one jamb (104) to the other (104) and the distance the bar (5) is required to span is more precise.

In homes, the interior width of most doorways (103) varies in two inch intervals from about 28 to 36 inches. While the bar (5) is shorter in an assembly upon a given door's face (101) than in one within its jamb (104), that required for the latter must either be manufactured at a made-to-order length or must be operably cut for emplacement into the opposing facial receptor sockets (12). In cutting the bar (5), allowance must be made for the thickness of the opposing guide rails (1) as well as for a portion of the receptor itself (7) which effectually shortens the span. Additional clearance of the order of about one inch is also preferred to permit some degree of play and accommodate jambs (104) which might be out-of-plumb.

The length of the bar (5) is, therefore, determined by the span which would exist between the opposing receptor facial socket's distal extremities (13)—that is, the distance across the doorway (103) between the deepest points, or bottoms, of the two sockets (12) if the receptors (7) had already been emplaced upon the rails (1).

In fact, the bar (5) must be emplaced in the respective sockets (12) before the pulley assembly can itself (19) be emplaced on the rails (1). It should be readily apparent that for door jamb (104) assembly, the bar (5) cannot be emplaced once the receptors (7) are present on the rails (1). It is, therefore, recommended the operator (200) take measurements for cutting with the receptors (7) in place but that they (7) be removed, linked with the remaining members of an entire pulley assembly (19) and then emplaced once again upon the rails (1). Because it is within the sockets (12) the bar ends (6) are emplaced for an acceptable fit, the socket distal extremities (13) are used as a measurement reference.

The exercise tethering points (300) thus far provided by the foregoing assemblies supra permit tension to be applied during exercise forward or outward from—that is, on the same generally horizontal level as—the crossbar (5) an exercise cord and operator tension manipulating assembly (26) is tethered from. Some upward tethering is possible, of course, by reason of the height of the horizontal crossbar (5) with reference to the operator (200). However, the invention comprises an additional optional member which permits exercise tension to be applied from tethering points (300) either more directly above or below the operator (200). To that end, there is provided a cantilevered tethering projection (70) comprising, as its (70) name suggests, an arm-like structure disposed outwardly at right angles to the supporting surface—whether door face (101) or wall (106)—providing one or more additional exercising tethering points (300).

A number of tethering projections (70) could be disposed upon a given guide rail (1). To avoid crowding, it is preferred that only one (70) be generally so employed, disposed to permit mounting a pulley assembly (19) upon it (70) at either an overhead or ankle height locus. Although mounting may be accomplished either proximate or distal the guide rails (1), since means are provided for both, ante, a distal site provides tethering points (300) well outward away from the wall (106) or door (100) upon which the exercise assembly is erected. When so mounted, the pulley assembly's tethering terminal (20) is designated herein a first horizontal crossbar(5). A second horizontal crossbar (5) is mounted proximate the guide rails (1) at the inward locus of a rail sliding receptor (7) upon which the cantilevered projection (70) is anchored and which (7) permits its (70) height adjustment.

Figure 7:
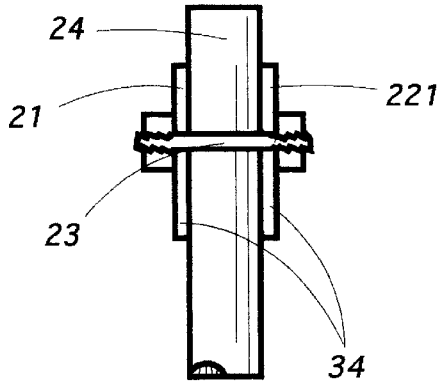

To aid in anchoring the tethering projection (70), each (70) comprises along its (70) sides opposing embracing flanges (71) which comprise two sets of bar emplacement projection sockets (73) of the same size as those (12) comprised by the sliding receptors (7). Each projection (70) is configured as an "U" shaped channel, the closed portion of the "U" (72) disposed toward the ends of the rail (1) and the open portion (74) away therefrom—that is, the closed portion is oriented upwards if the projection (70) is mounted above the operator's (200) head as shown in FIG. 7, or downwards if mounted nearer the floor (107). This disposition facilitates operator (200) access to the open portion (74) to permit making height adjustments.

As the term "embracing" suggests, the flanges (71) fit snugly along the sides of the rail sliding receptor (7), as shown in FIG. 1. As illustrated in FIGS. 8 and 9, the receptor (7) is configured with indentations therein (7), disposed along its sides (10) such that the mounted projection (70) abuts them, thereby enhancing the security of its (70) emplacement.

The flanges (71) comprise pairs of projection sockets (73) proximate the rail (1) aligned to permit insertion of the second crossbar's ends (6) both through them (73) and the receptor emplacement sockets (12). Although, because there are a number of projection sockets (73) disposed in the flanges (71), several variations in arrangement are feasible for the most distally disposed crossbar (5). The connections are secured by means of stop rings (39) in the manner discussed supra for height adjusting pulley tethering assemblies (4).

The entire assembly comprising both the first and second crossbars (5) and the rail sliding receptor pair (7) disposed between each projection's flanges (71) may be adjusted to any height selected by the operator (200) in the same manner as 1n explained supra for pulley tethering assemblies (4).

Emplacement of a pulley assembly (19) upon the assembly's second horizontal crossbar (5), that proximate the rails (1), is optional.

The exercise assembly also optionally comprises a stabilizing bar (90) which extends outward so that it may be gripped for bracing support by the operator (200) during certain exercises such as one solely for the legs. The stabilizing bar (90) comprises a receptor emplacement end (91) and an operator stabilizing end (92). A handle (93) is disposed proximate the operator end (92) and preferably, for sake of simplicity and economy of manufacture, merely comprises ULf shape.

Figure 18:
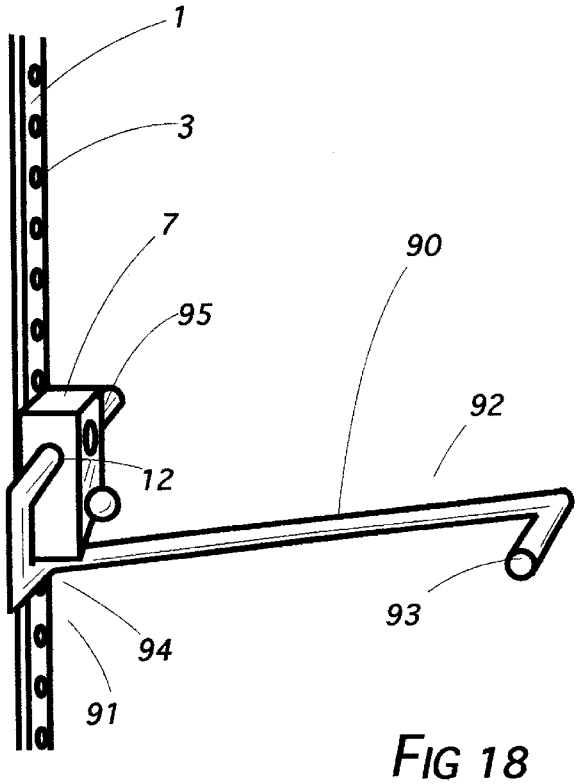
FIG. 18 is a perspective view of a stabilizing bar (90), an optional accessory shown in engagement with a rail sliding receptor (7), providing operator (200) bracing security when conducting exercise.
Figure 19:
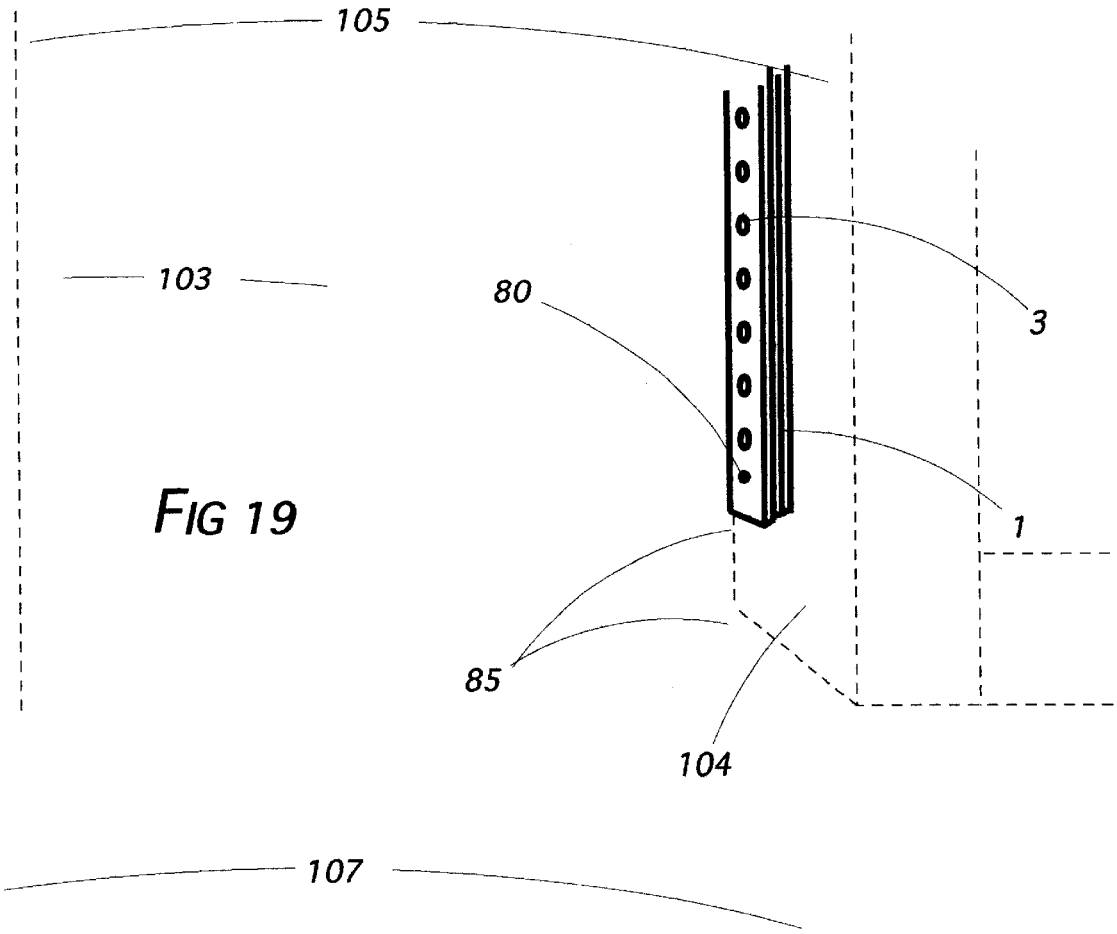
FIG. 19 depicts an installation of the invention within a doorway (103) and against the jamb (104) thereof and also comprising a receptor emplacement gap (85).

The stabilizing bar (90) also comprises stabilizing fulcrum configuration (94) such as that shown in FIG. 18, wherein a portion of the operator end (92) comprises bends which are braced against the guide rail (1) in the manner of a lever's fulcrum when the operator's (200) weight bears upon it (90). Preferably, the fulcrum configuration (94) comprises a"C" shaped bend in the bar (90) as shown, enhancing breadth and strength as bracing means when employed.

The bar (90) is configured at its receptor emplacement end (91) with a receptor emplacement finger (95), configured so that it may be inserted through the receptor's laterally disposed bar emplacement sockets (12) in the same manner as done with a horizontal crossbar (5), explained supra.

The inventor hereby claims:

1. An elastic cord exercising assembly comprising a pair of vertically disposed guide rails;

an operator tension manipulating assembly; and at least one height adjusting pulley tethering assembly;

each guide rail comprising spaced latching apertures disposed in the face thereof along its length;

the operator tension manipulating assembly comprising a length of elastic exercise cord and a pair of operator tension manipulators, each disposed at a cord end;

each height adjusting pulley tethering assembly comprising:

a crossbar in turn comprising a pair of pulley tethering terminals;

a pair of acentric pulley assemblies; and a pair of rail sliding receptors, each respectively disposed proximate a crossbar end;

each acentric pulley assembly comprising a crossbar tethering leg comprising in turn:

a bar tethering ring comprising inner diameter greater than the crossbar's outer diameter and disposed to encircle the crossbar to a predetermined degree;

an acentrically projecting foot; and an interleaf axle pivot disposed upon the foot so as to confer acceleration varied virtual diameter upon the tethering ring;

each pulley assembly further comprising:

a pulley wheel comprising in turn a circumferential groove;

a pulley axle frame wherein the wheel is disposed, the frame comprising in turn an elastic cord emplacement gate wherein the elastic cord is passed for emplacement within the circumferential groove of the pulley wheel;

a tethering leg pulley swivel disposed at one end to engage the interleaf axle pivot in axial transversion and at the other to axially engage the axle frame;

each rail sliding receptor comprising:

a rail engagement underside comprising two opposing rail emplacement lips mated in shape to a rail's cross section;

a pair of opposing sides comprising in turn crossbar emplacement sockets of size to receive one of the crossbar's ends;

a retractable spring loaded pin latch assembly; and a spring thrusting shoulder disposed within it;

the retractable spring loaded pin latch assembly comprising:

a guide rail aperture engaging pin of size to fit snugly into any one of the guide rail's latching apertures, the pin comprising in turn a spring retracting shoulder a spring disposed to impel and retain the engaging pin into a guide rail latching aperture; and a latch handle attached to the pin;

whereby the height of the pulley tethering assembly is adjusted by unlatching the pin latch assembly, moving the tethering assembly to a different selected height and latching it thereat.

2. The elastic cord exercising assembly according to claim 1, wherein the disposition of the guide rails is vertical identically oriented parallel.

3. The elastic cord exercising assembly according to claim 1, wherein the sockets disposed in the rail sliding receptor's sides are so aligned and of such depth that upon assembly, the crossbar's ends pass straightly therethrough, the height adjusting assembly thereof comprising two stop rings, one disposed between each rail sliding receptor and a crossbar end; and each stop ring comprising a set screw disposed to secure the ring to the crossbar;

whereby the crossbar is prevented from unintended dislodgement from an exercise assembly mounted upon a wall or other vertical surface.

4. The elastic cord exercising assembly according to claim 3 further comprising a mounting channel attached longitudinally to each guide rail thereof to comprise thereby a pair of rail frames disposed vertically upon a door;

four surface protection door connection assemblies, each disposed at the ends of the rail frames;

each door connection assembly comprising a retraction bolt; and a door connection bracket comprising a door bracketing end disposed to bracket the door's top and bottom edges a rail frame emplacement end comprising a tongue of size sufficiently small to fit within the end of a mounting channel wherein it is emplaced;

retraction plate projection configuration; and a door connection bracket tongue aperture comprising threads mated to those of the retraction bolt;

whereby an operator may engage in a variety of exercises tethered to a vertical surface wherein the exercise assembly is mounted upon a door such that it neither usurps otherwise unavailable wall space nor damages the door.

5. The elastic cord exercising assembly according to claim 3 wherein the disposition of the guide rails is vertical facially opposing parallel within and attached to a door jamb, further comprising length wherein a receptor emplacement gap is disposed upon at least one end of each rail;

each rail sliding receptor further comprising a face oppositely disposed the receptor's rail engagement underside so as to dispose the two receptor faces toward one another within the jamb; and a bar emplacement socket disposed in each of the faces, each socket comprising depth and a distal extremity at the deepest point therein, thereby disposing a span of distance across the door opening between one distal extremity and the other;

each pulley tethering bar comprising length slightly less than that spanning a distance between the opposing distal extremities;

whereby upon emplacement of each acentric pulley assembly upon a respective crossbar, insertion of each of the bar's ends into a respective facial receptor emplacement socket and emplacement of each end of the assembly within the receptor emplacement gap and upon each respective rail, the height of the crossbar may operably be set and adjusted by latching the receptors at a selected height; and the assembly's tethering points may operably be disposed at any selected loci upon the bar by operably positioning each pulley assembly therealong by means which include tugging laterally upon the exercise cord emplaced thereupon; whereupon an operator may engage in a variety of exercises wherein the assembly is mounted such that it does not usurp otherwise unavailable wall space.

6. The elastic cord exercising assembly according to claim 3, further comprising a pair of cantilevered tethering projections comprising lateral emplacement sockets distal the guide rail wherein a first horizontal crossbar is disposed in a projected position;

a second crossbar the ends of which are disposed in lateral emplacement sockets proximate the respective guide rails; and two pairs of stop rings;

wherein the sockets disposed in the rail sliding receptor's sides are so aligned and of such depth that upon assembly, the second crossbar's ends pass straightly therethrough;

the sockets comprising size to receive the ends of either of the first and second crossbars;

a first pair of the stop rings being disposed between each cantilevered tethering projection and the first crossbar's ends proximate thereto and a second pair being disposed between each receptor and the second crossbar's ends proximate thereto;

the stop rings further comprising set screws to secure them upon the respective crossbars;

whereby both crossbars are prevented from unintended dislodgement, the height of the crossbar is adjusted proximate the rail frames and the tethering points of the pulley tethering assemblies are adjusted at the projected position distal the rail frames.

7. The elastic cord exercising assembly according to claim 1 further comprising a stabilizing bar comprising an emplacement finger disposed at a first end thereof and configured for insertion through the lateral bar emplacement sockets of a rail sliding receptor;

a handle disposed at a second end thereof;

stabilization fulcrum configuration;

wherein the stabilizing bar is disposed as a brace upon the guide rail when an operator's weight bears against it;

whereby the operator may attain additional stability while conducting certain exercises.

8. The elastic cord exercising assembly according to claim 1 wherein the guide rails comprise "I" beam configuration.

9. The elastic cord exercising assembly according to claim 1 wherein the distances between adjoining spaced latching apertures upon a rail are equal.

10. The elastic cord exercising assembly according to claim 1 wherein the predetermined degree of tethering ring's encirclement of the crossbar is such as to circumscribe it substantially.

11. The elastic cord exercising assembly according to claim 1 wherein the degree of tethering ring's encirclement of the crossbar is such as to circumscribe it only partially.

12. The elastic cord exercising assembly according to claim 1 wherein the tethering leg comprises single leaf configuration.

13. The elastic cord exercising assembly according to claim 1 wherein the tethering leg comprises double leaf configuration.

14. An acentric pulley assembly comprising a crossbar tethering leg comprising in turn:

a bar tethering ring comprising inner diameter greater than the crossbar's outer diameter and disposed to encircle the crossbar to a predetermined degree;

an acentrically projecting foot; and an interleaf axle pivot disposed upon the foot so as to confer acceleration varied virtual diameter upon the tethering ring;

each pulley assembly further comprising:

a pulley wheel comprising in turn a circumferential groove;

a pulley axle frame wherein the wheel is disposed, the frame comprising in turn an elastic cord emplacement gate wherein the elastic cord is passed for emplacement within the circumferential groove of the pulley wheel;

a tethering leg pulley swivel disposed at one end to engage the interleaf axle pivot in axial transversion and at the other to axially engage the axle frame;

whereby a given task's tethering points may operably be disposed at any selected loci upon the bar by operably positioning each pulley assembly therealong by means which include tugging laterally upon the exercise cord emplaced thereupon; whereupon an operator may perform a variety of tasks.

15. A pair of rail sliding receptors for opposing guide rails, each receptor comprising a rail engagement underside comprising two opposing guide rail emplacement lips mated in shape to a spaced apertured guide rail's cross section;

a pair of opposing sides comprising in turn crossbar emplacement sockets of size to receive one of a horizontally disposed crossbar's ends;

a retractable spring loaded pin latch assembly; and a spring thrusting shoulder disposed within it;

the retractable spring loaded pin latch assembly comprising:

a guide rail aperture engaging pin of size to fit snugly into any one of a guide rail's latching apertures, the pin comprising in turn a spring retracting shoulder a spring disposed to impel and retain the engaging pin into a guide rail latching aperture; and a handle attached to the pin;

whereby the height of a given pulley tethering assembly is adjusted by unlatching the pin latch assembly, moving the tethering assembly to a different selected height and latching it thereat.

16. The pair of rail sliding receptors according to claim 15 wherein the bar emplacement sockets are disposed in the opposing sides of the receptors.

17. The pair of rail sliding receptors according to claim 15 wherein the bar emplacement sockets are disposed in the faces of the rail sliding receptors.

18. A surface protecting door connecting assembly comprising a pair of mounting channels each attached longitudinally to a pair of guide rails to comprise thereby a pair of rail frames disposed vertically upon a door;

a retracting bolt; and a door connecting bracket comprising a door bracketing end disposed to bracket the door's top and bottom edges a rail frame emplacement end comprising a tongue of size sufficiently small to fit within the end of a mounting channel wherein it is emplaced;

retracting plate projection configuration; and a door connecting bracket tongue aperture comprising threads mated to those of the retracting bolt;

whereby an operator may engage in a variety of exercises tethered to a vertical surface wherein the exercise assembly is mounted upon a door such that it neither usurps otherwise unavailable wall space nor damages the door.

* * * * *